US009074417B2

(12) United States Patent
Cooper et al.

(10) Patent No.: US 9,074,417 B2
(45) Date of Patent: Jul. 7, 2015

(54) GRID KEEPER FOR INSULATING GLASS UNIT, AND/OR INSULATING GLASS UNIT INCORPORATING THE SAME

(71) Applicant: Guardian Industries Corp., Auburn Hills, MI (US)

(72) Inventors: David J. Cooper, Canton, MI (US); Robert A. Miller, Sylvania, OH (US)

(73) Assignee: Guardian Industries Corp., Auburn Hills, MI (US)

( * ) Notice: Subject to any disclaimer, the term of this patent is extended or adjusted under 35 U.S.C. 154(b) by 0 days.

(21) Appl. No.: 14/162,800

(22) Filed: Jan. 24, 2014

(65) Prior Publication Data

US 2014/0137490 A1 May 22, 2014

Related U.S. Application Data

(62) Division of application No. 13/339,717, filed on Dec. 29, 2011, now Pat. No. 8,667,762.

(60) Provisional application No. 61/457,106, filed on Dec. 29, 2010.

(51) Int. Cl.

| | |
|---|---|
| ***E04C 2/38*** | (2006.01) |
| ***E06B 3/667*** | (2006.01) |
| ***E06B 3/68*** | (2006.01) |
| ***E06B 3/66*** | (2006.01) |

(52) U.S. Cl.

CPC ..... *E06B 3/6675* (2013.01); *E06B 3/685* (2013.01); *E06B 3/6604* (2013.01); *Y10T 29/49966* (2015.01)

(58) Field of Classification Search

CPC ..... E06B 3/685; E06B 3/6604; E06B 3/6675; E06B 3/5821

USPC ..... 52/204.61, 656.5, 713, 714

See application file for complete search history.

(56) References Cited

U.S. PATENT DOCUMENTS

| | | | | |
|---|---|---|---|---|
| 3,372,522 | A * | 3/1968 | Engstrom | 52/456 |
| 3,708,939 | A * | 1/1973 | Herr | 52/456 |

(Continued)

FOREIGN PATENT DOCUMENTS

| | | |
|---|---|---|
| WO | WO 02/46547 | 6/2002 |
| WO | WO 2006/050508 | 5/2006 |

OTHER PUBLICATIONS

U.S. Appl. No. 13/339,717, filed Dec. 29, 2011; Cooper et al.

(Continued)

*Primary Examiner* — Basil Katcheves
*Assistant Examiner* — Joshua Ihezie
(74) *Attorney, Agent, or Firm* — Remarck Law Group PLC

(57) ABSTRACT

Certain example embodiments of this invention relate to internal grid keepers for insulating glass units, and/or insulating glass units incorporating the same. The grid keepers of certain example embodiments may include a shoulder bent into an acute angle and may include one or more stamped features on or proximate to the shoulder for engaging with a punched, hollowed, or otherwise formed feature in an edge seal, along with one or more stamped features on an elongate portion extending from the shoulder for engaging with a grid or muntin. In certain example embodiments, the keeper may be on level with or slightly lower than a primary seal so as to reduce the likelihood of the keeper interfering with the seal.

15 Claims, 6 Drawing Sheets

(56) References Cited

U.S. PATENT DOCUMENTS

| | | | | | |
|---|---|---|---|---|---|
| 3,848,390 | A * | 11/1974 | Anderson et al. | 52/656.9 |
| 4,467,578 | A * | 8/1984 | Weinar | 52/281 |
| 4,621,473 | A * | 11/1986 | Wendt | 52/489.2 |
| 4,802,294 | A * | 2/1989 | Baus | 40/782 |
| 4,854,100 | A * | 8/1989 | La See | 52/456 |
| 4,949,521 | A * | 8/1990 | Riegelman et al. | 52/456 |
| 5,127,762 | A * | 7/1992 | Havlovitz | 403/298 |
| 5,205,102 | A * | 4/1993 | Plummer | 52/656.9 |
| 5,514,476 | A | 5/1996 | Hartig et al. | |
| 5,784,853 | A | 7/1998 | Hood et al. | |
| 5,800,933 | A | 9/1998 | Hartig et al. | |
| 6,014,872 | A | 1/2000 | Hartig et al. | |
| 6,128,871 | A * | 10/2000 | Corey | 52/204.61 |
| 6,131,356 | A * | 10/2000 | Gieseke | 52/656.5 |
| 6,155,010 | A * | 12/2000 | Becken et al. | 52/204.61 |
| 6,494,002 | B1 * | 12/2002 | Gieseke | 52/204.61 |
| 6,521,821 | B2 * | 2/2003 | Makita et al. | 136/244 |
| 6,632,491 | B1 | 10/2003 | Thomsen et al. | |
| 7,076,927 | B2 * | 7/2006 | Trpkovski | 52/204.5 |
| 2006/0096215 | A1 * | 5/2006 | Gieseke | 52/456 |
| 2007/0128449 | A1 | 6/2007 | Taylor et al. | |
| 2009/0120018 | A1 | 5/2009 | Trpkovski | |
| 2009/0120019 | A1 | 5/2009 | Trpkovski | |
| 2009/0120035 | A1 | 5/2009 | Trpkovski | |
| 2009/0120036 | A1 * | 5/2009 | Trpkovski | 52/786.13 |
| 2009/0123694 | A1 | 5/2009 | Trpkovski | |
| 2009/0158677 | A1 * | 6/2009 | Liang et al. | 52/204.62 |
| 2011/0131903 | A1 * | 6/2011 | Ifko | 52/204.61 |

OTHER PUBLICATIONS

U.S. Appl. No. 61/457,106, filed Dec. 29, 2010; Cooper et al.
U.S. Appl. No. 13/067,420, filed May 31, 2011; Cooper.
Edgetech: IntelliClip Targeted Grid Placement Technology (3pgs).

* cited by examiner

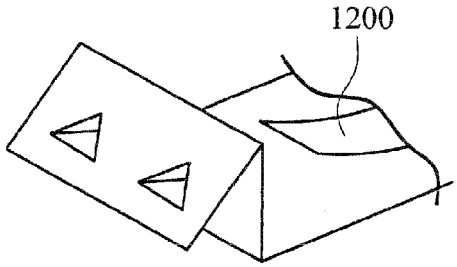
Fig. 12
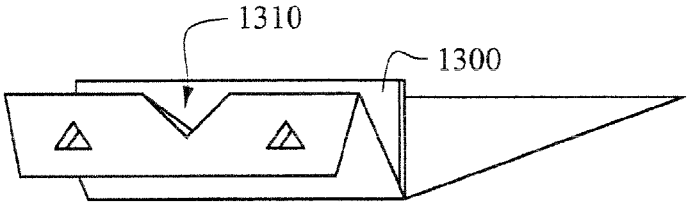
Fig. 13
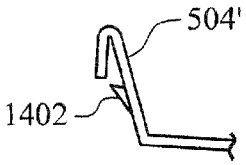
Fig. 14
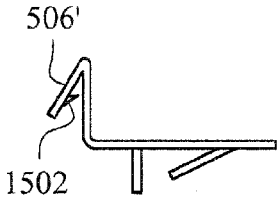
Fig. 15
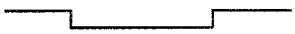
Fig. 16a
Fig. 16b
Fig. 16c

GRID KEEPER FOR INSULATING GLASS UNIT, AND/OR INSULATING GLASS UNIT INCORPORATING THE SAME

CROSS-REFERENCE TO RELATED APPLICATION

This application is a divisional of application Ser. No. 13/339,717, filed Dec. 29, 2011, which claims priority on Provisional Ser. No. 61/457,106 filed Dec. 29, 2010, the entire disclosures of which are all hereby incorporated herein by reference in this application.

FIELD OF THE INVENTION

Certain example embodiments of this invention relate to insulating glass units, and/or methods of making the same. More particularly, certain example embodiments of this invention relate to internal grid keepers for insulating glass units, and/or insulating glass units incorporating the same. The grid keepers of certain example embodiments may include a shoulder bent into an acute angle and may include one or more stamped features on or proximate to the shoulder for engaging with a punched, hollowed, or otherwise formed feature in an edge seal, along with one or more stamped features on an elongate portion extending from the shoulder for engaging with a grid or muntin.

BACKGROUND AND SUMMARY OF EXAMPLE EMBODIMENTS OF THE INVENTION

Insulating glass units (IG units or IGUs) are known. For example, IG units include first and second substantially parallel, spaced apart glass substrates. The first and second substrates may be the same size or differently sized in different applications. A spacer or spacer system is provided at the peripheral edges so as to help maintain the first and second substrates in substantially parallel, spaced apart relation to one another. An air gap or cavity is defined between the two substrates. In some cases, the air gap or cavity may be filled with an inert or other gas (such as, for example, Ar, Xe, Ne, or the like).

A muntin or muntin bar is a strip of material (oftentimes wood or metal) that separates and holds substrates in a window. Muntins help create a grid system used to divide panes of glass into a single window sash or casement, e.g., for decorative or aesthetic purposes.

Windows with "true" divided lites sometimes incorporate thin muntins positioned between individual panes of glass. Differently stated, a "true muntin" is a strip of wood or similar material that completely separates panes of glass. In some cases, small IG units may be used in place of single panes of glass, although this arrangement reduces the insulating effect of the smaller IG units. In certain other cases, however, the illusion of muntins is created by affixing grilles to an outer surface of the glass. In certain other cases, the illusion of muntins is created by providing an IG unit with a grid (e.g., of wood, metal, or the like) sandwiched between its two glass substrates, thereby helping to create an illusion of a "true" divided lite while also providing some of insulating benefits associated with IG units. Shadow boxes also are sometimes used for these or similar purposes. Shadow boxes, which typically are dark in color, generally refer to rectangular profiles that typically are placed between the panes of glass at the locations of external grids.

In cases where a grid is provided between the two glass substrates of an IG unit, clips or the like are sometimes provided for helping to maintain the position of the grid relative to the overall unit. These structures are sometimes referred to as "keepers," and they sometimes are as simple as clips attached to the spacer system.

Unfortunately, the provision of keepers and internal muntins sometimes may be problematic. For instance, some keepers lack a rigidity suitable for holding the internal grid system substantially in place. The grids therefore may become displaced or dislodged. Similarly, some keepers may become detached from the structure(s) to which they are at least initially connected (e.g., during transport, installation, etc.). Keepers also may sometimes undermine the quality of the seal formed. This negative effect on the seal may, in turn, allow moisture or oxygen to penetrate into the gap between the substrates. Similarly, it may allow inert or other gas provided in the cavity to exit at a quicker rate than otherwise would be the case. Furthermore, even if the seal is maintained, the keeper material may outgas over time.

Thus, it will be appreciated that it would be desirable to provide improved internal grid keepers for insulating glass units, and/or insulating glass units incorporating the same.

In certain example embodiments of this invention, a grid keeper for an insulating glass (IG) unit is provided. An elongate body portion is adapted to extend into a cavity of the IG unit and further adapted to be received into a cavity formed in a muntin bar or grid assembly of the IG unit. A generally upright member extends from an end of the body portion to be positioned closest to a spacer of the IG unit. A shoulder portion extends downwardly from and at an acute angle to the generally upright member. The shoulder portion is adapted to hook to an upwardly extending blade of the spacer of the IG unit.

In certain example embodiments of this invention, an insulating glass (IG) unit is provided. First and second substantially parallel spaced apart glass substrates at least partially define a gap therebetween. A spacer system is provided around edges of the first and/or second glass substrates, with the spacer system including at least one upwardly extending blade. A muntin bar assembly is located within the gap. One or more clips hold the muntin bar assembly substantially in place. Each said clip comprises: an elongate body portion extending into the gap and being received by a cavity formed in the muntin bar assembly, and a shoulder integral with the elongate body portion and configured to book onto the blade of the spacer system at a bend thereof, with the bend being formed at an angle less than 90 degrees.

In certain example embodiments of this invention, a method of making an insulating glass (IG) unit is provided. First and second glass substrates are provided. A spacer system is provided around edges of the first and/or second glass substrates, with the spacer system including at least one upwardly extending blade. One or more clips are connected to the blade via a bend provided to each of the clips. Elongate body portion(s) of the one or more clips is/are inserted into one or more corresponding cavities of a muntin bar assembly to hold the muntin bar assembly in place. The IG unit is sealed such that the first and second glass substrates are provided in substantially parallel spaced apart relation to one another and such that the muntin bar assembly is located in a gap between the first and second glass substrates. The bend in each said clip is provided at an acute angle less than 90 degrees.

The features, aspects, advantages, and example embodiments described herein may be combined to realize yet further embodiments.

BRIEF DESCRIPTION OF THE DRAWINGS

These and other features and advantages may be better and more completely understood by reference to the following detailed description of exemplary illustrative embodiments in conjunction with the drawings, of which:

FIGS. 12-15 show further modifications to clip-type keepers that are possible in connection with certain example embodiments; and FIGS. 16A-16C show different cavity spacer blade profiles that may be used in connection with certain example embodiments.

DETAILED DESCRIPTION OF EXAMPLE EMBODIMENTS OF THE INVENTION

Certain example embodiments relate to an internal grid keeper. For instance, certain example embodiments of this invention relate to internal grid keepers for insulating glass units, and/or insulating glass units incorporating the same. The grid keepers of certain example embodiments may include a shoulder bent into an acute angle and may include one or more stamped features on or proximate to the shoulder for engaging with a punched, hollowed, or otherwise formed feature in an edge seal, along with one or more stamped features on an elongate portion extending from the shoulder for engaging with a grid or muntin. In certain example embodiments, the keeper may be on level with or slightly lower than a primary seal so as to reduce the likelihood of the keeper interfering with the seal. Additionally, or in the alternative, the design of the keeper may facilitate a physical separation between the metal of the keeper and the glass. This advantageously may provide a thermal break between the glass and spacer bar, and the keeper and grid system. In addition, the keepers of certain example embodiments may be adaptable to different hollow grid members, e.g., by virtue of the locator features provided thereon. For instance, a hollow grid may slide into a keeper and become "locked" in place by virtue of one or more tab features, such that it becomes difficult to remove the grid once in place.

The internal grid keeper may be made of a metal, for instance, and may be designed for use with standard muntin bar profiles, e.g., to attach the bar end to a spacer including two blades of metal. The internal IG cavity spacer blade may be punched with a small shape to help locate the keeper. In certain example embodiments, the shape of the punch may be substantially rectangular, although other shapes may be used based in part on ultimate keeper design. The punch allows the keeper to be inserted onto the spacer, whereby the elevation of the keeper is substantially equal to the elevation of the spacer blade.

As alluded to above, the keeper of certain example embodiments may be made of a non-outgassing metal material, such as steel, aluminum, stainless steel, or the like. The keeper may be designed to hold itself in place on the spacer, e.g., by means of small sharp projections punched into sides. In certain example embodiments, no secondary fasteners (e.g., screws or the like) may be needed. For instance, the keeper of certain example embodiments may be designed to hold itself in the hollow cavity of standard muntin bar profiles and/or ma be compatible with IET or other twin blade IG spacer systems.

Figure 1:
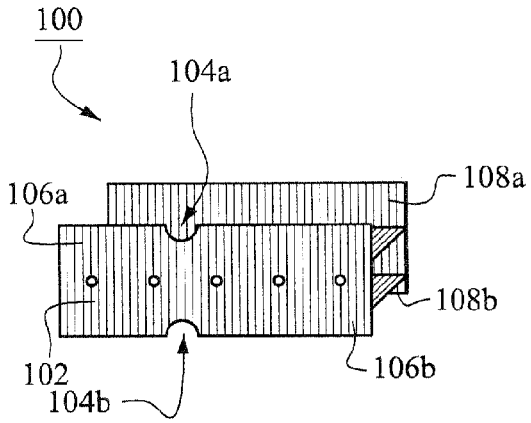
FIG. 1 is a partial perspective view of an example spacer system.
Figure 2:
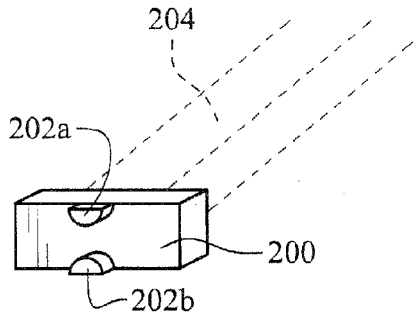
FIG. 2 shows an example grid keeper and an example muntin bar assembly that is connectable to the example spacer system of FIG. 1.

Referring now more particularly to the drawings, FIG. 1 is a partial perspective view of an example spacer system, and FIG. 2 shows an example grid keeper and an example muntin bar assembly that is connectable to the example spacer system of FIG. 1. The example spacer 100 shown in FIG. 1 is a corrugated metal spacer system that includes a main body portion 102. Features 104*a* and 104*b* are punched into an inner set of top and bottom blades 106*a* and 106*b*, respectively. In the FIG. 1 example, no features are punched in the outer set of top and bottom blades 108*a* and 108*b*, although different example embodiments may incorporate punches in one or both sides of either or both of the top and bottom sets of blades. The spacer may be a suitably modified version of the spacer system disclosed, for example, in U.S. application Ser. No. 13/067,420, filed on May 31, 2011, or any one of for example, U.S. Publication Nos. 2009/0120019; 2009/0120036; 2009/0120018; 2009/0120035; and 2009/0123694. The entire contents of each of these patent documents is hereby incorporated herein by reference. The FIG. 1 example spacer may be created at a line speed of at least about 20 feet per minute in some cases. It is noted that the corrugations are omitted from later views for clarity purposes. It will be appreciated that other corrugated or non-corrugated spacer systems may be used in connection with different embodiments of this invention.

The keeper 200 shown in FIG. 2 may be plastic in certain example embodiments, and it may have first and second protrusions 202*a* and 202*b* or other features for engaging with the first and second punches 104*a* and 104*b* of the example spacer 100 shown in FIG. 1. A muntin bar may be connected to the keeper 200. For instance, as elaborated on below, the muntin bar may have an at least partially hollowed out interior suitable for receiving a protruding member from the keeper 200. It also will be appreciated that more or fewer holes 104 may be punched in the spacer 100 for accommodating the same, more, or fewer corresponding protrusions 202 of the keeper 200.

Figure 3:
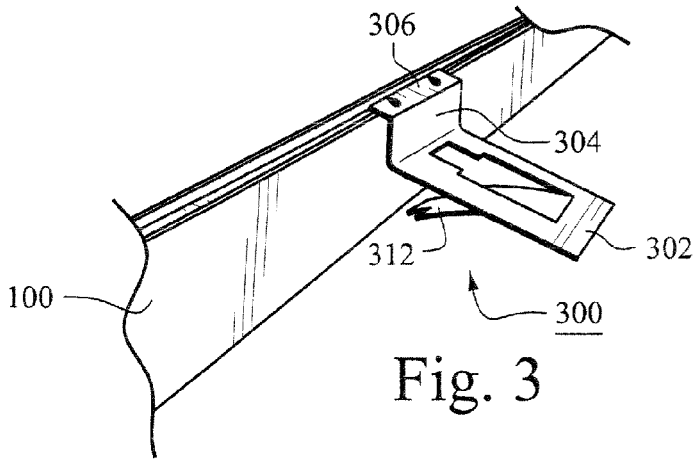
FIGS. 3-4 show an example improved metal clip design that is connectable to an example spacer system.
Figure 4:
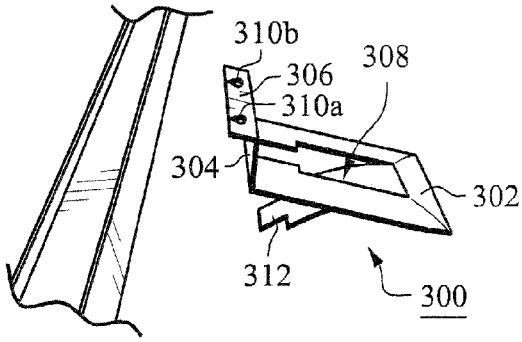
Figure 5:
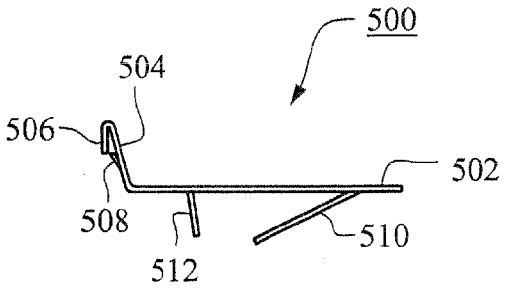
FIGS. 5-8 are different schematic views of a further example improved metal clip design that is connectable to an example spacer system in accordance with certain example embodiments.
Figure 6:
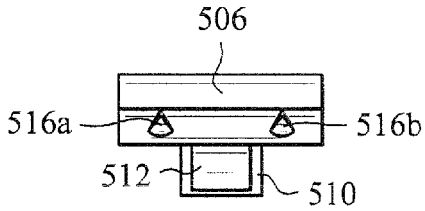
Figure 7:
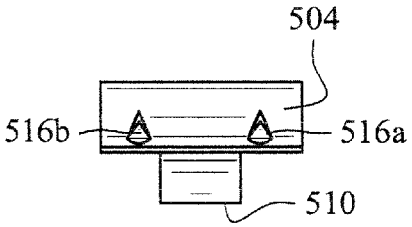
Figure 8:
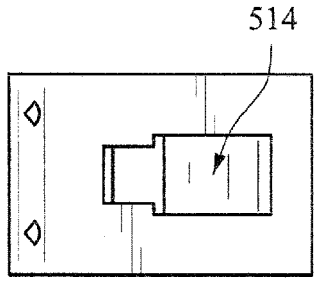

Improvements to the arrangement of FIGS. 1-2 may be desirable, e.g., in terms of increased rigidity and/or less interference with the primary seal of the IG unit. FIGS. 3-4 show an example improved metal clip design that is connectable to an example spacer system. The example metal clip 300 shown in FIGS. 3-4 reduces the amount of moisture that is introduced into the IG unit because it interferes less with the primary seal thereof. The metal clip 300 shown in FIGS. 3-4 includes a main body portion 302 that extends outwardly into the cavity of the IG unit and ultimately into a grid, a generally upright member 304 that extends from an end of the main body portion 302 that is to be positioned nearest the spacer system 100, and a shoulder portion 306 that extends from the top of the generally upright member 304 and that is to lie over the inner blade of the spacer system 100. The main body portion 302 may have a significant portion thereof removed, thereby creating a hole 308. This hole 308 may reduce the weight of the structure and reduce the likelihood of the clip 300 falling into the cavity of the IG unit. Furthermore, the shoulder portion 306 may include one or more stamped features 310*a* and 310*b* that engage with or lean against the blade, also to help reduce the likelihood of the clip 300 falling into the cavity of the IG unit. The blades may be punched differently from the manner shown in FIG. 1 for accommodating these features 310*a* and 310*b*. It also will be appreciated that more or fewer features 310 may be provided to the shoulder portion 306. The features 310*a* and 310*b* also may help locate the clip relative to the spacer. As shown in FIGS. 3-4, a tongue 312 is cutout from the main body portion 302 and bent downwardly.

The designs discussed in connection with FIGS. 3-4 may be further improved upon in certain example situations. For example, these designs may be improved upon by bending the upper substantially horizontal attachment member or shoulder shown above into a more V-like, bent shoulder shape. The bent shoulder shape may help to lock onto the spacer in certain example embodiments. This arrangement is shown in the figures discussed below, e.g., in connection with FIGS. 5-15. It is noted that that part numbers 4SCBT, 4MCBT, 7MCBT, 4LCBT, 6SCBT, 6LCBT, and/or the like, commercially available from Edgetech IG may be bent and/or otherwise modified to achieve the example profiles shown below.

FIGS. 5-8 are different schematic views of a further example improved metal clip design that is connectable to an example spacer system in accordance with certain example embodiments. The example clip 500 may be somewhat similar to the example clip 300. For example, the example clip 500 may include a main body portion 502 that extends outwardly into the cavity of the IG unit and ultimately into a grid, a generally upright member 504 that extends from an end of the main body portion 502 that is to be positioned nearest the spacer system 100, and a shoulder portion 506 that extends from the top of the generally upright member 504 and that is to lie over the inner blade of the spacer system 100. The main body portion 502 also may have a significant portion thereof removed, thereby creating a hole 514. This hole 514 may reduce the weight of the structure and reduce the likelihood of the clip 500 falling into the cavity of the IG unit. Furthermore, the shoulder portion 504 may include one or more stamped features 516*a* and 516*b* that engage with or lean against the blade, also to help reduce the likelihood of the clip 500 falling into the cavity of the IG unit. The blades may be punched differently from the manner shown in FIG. 1 for accommodating these features 516*a* and 516*b*. It also will be appreciated that more or fewer features 516 may be provided to the shoulder portion 506. The features 516*a* and 516*b* also may help locate the clip relative to the spacer.

An upwardly extending cushioning member 508 may be provided to the generally upright member 504 so that it can come into contact with the spacer system when the clip is installed and/or during normal loading or expansion/contraction of the IG unit. This may help reduce the likelihood of the clip 500 rotating too far inward and thus falling off of the blade. The acute angle (preferably less than 75 degrees, more preferably less than 60 degrees, and still more preferably less than 50 degrees, with example angles being 45-55 degrees and one particular example being 45 degrees) between the shoulder portion 506 and the generally upright member 504 also may help in this respect. The generally downwardly extending member 512 may help to reduce the likelihood of the grid being inserted too far inwardly or too close to the spacer system. The angled member 510 extending from a front end of the main body portion 502 of the clip may help locate the grid and/or lock it into place as described in greater detail below.

In certain example embodiments, the angle between the main body portion 502 and the generally upright member 504 preferably is at least about 90 degrees, more preferably 90-135, and still more preferably 95-120, with an example angle being 106 degrees.

In certain example embodiments, the angle between the main body portion 502 and the generally downwardly extending member 512 preferably is at least about 90 degrees, more preferably 90-120, and still more preferably 95-110, with an example angle being 98 degrees.

In certain example embodiments, the angle between the main body portion 502 and the angled member 510 measured between the very end of the main body portion 502 and the surface of the angled member 510 closest the cavity preferably is greater than 90 degrees, more preferably 120-175 degrees, and still more preferably 135-160 degrees, with an example angle being 153 degrees.

One, some, or all of the cushioning member 508, the angled member 510, and the generally downwardly extending member 512 is/are capable of receiving some bias, e.g., during manufacturing processes.

It is noted that FIGS. 5-8 are shown to scale. However, different example embodiments may use other different scales for the various features. In other words, the various features shown in these drawings need not necessarily be provided in the exact proportions shown in or extrapolatable from them.

Figure 9:
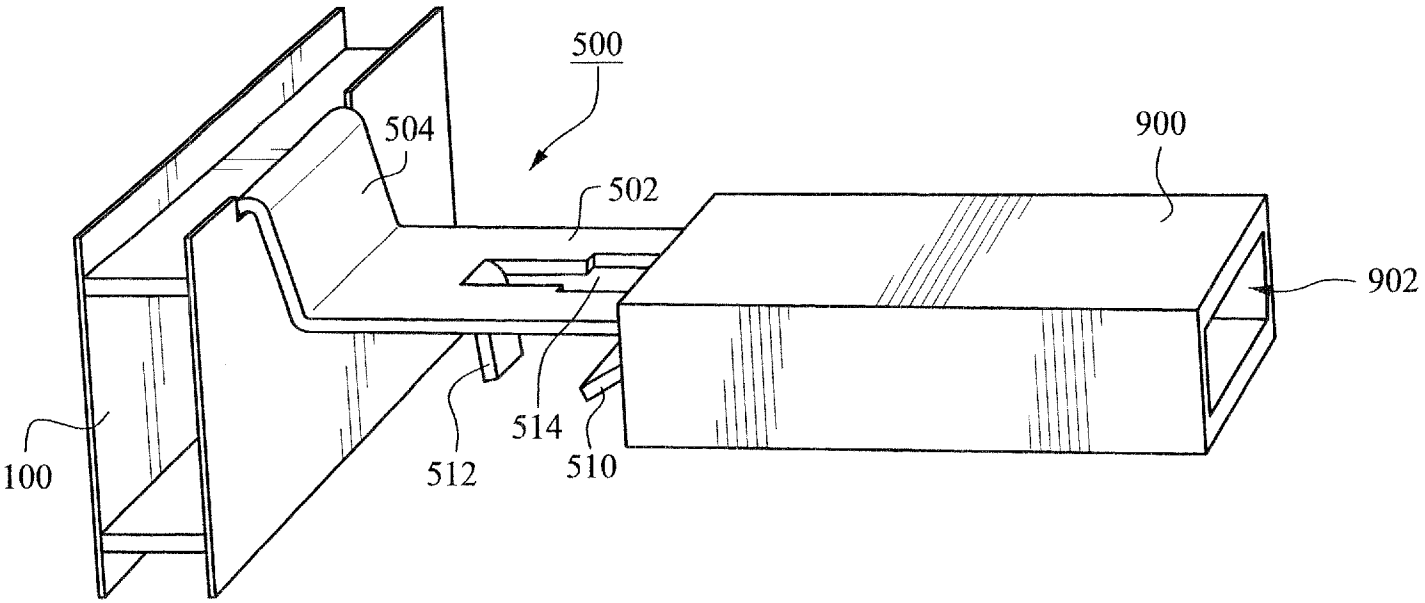
FIGS. 9-11 demonstrate an at least partially assembled keeper and grid system, including a bent clip with notched spacer design, in accordance with certain example embodiments.
Figure 10:
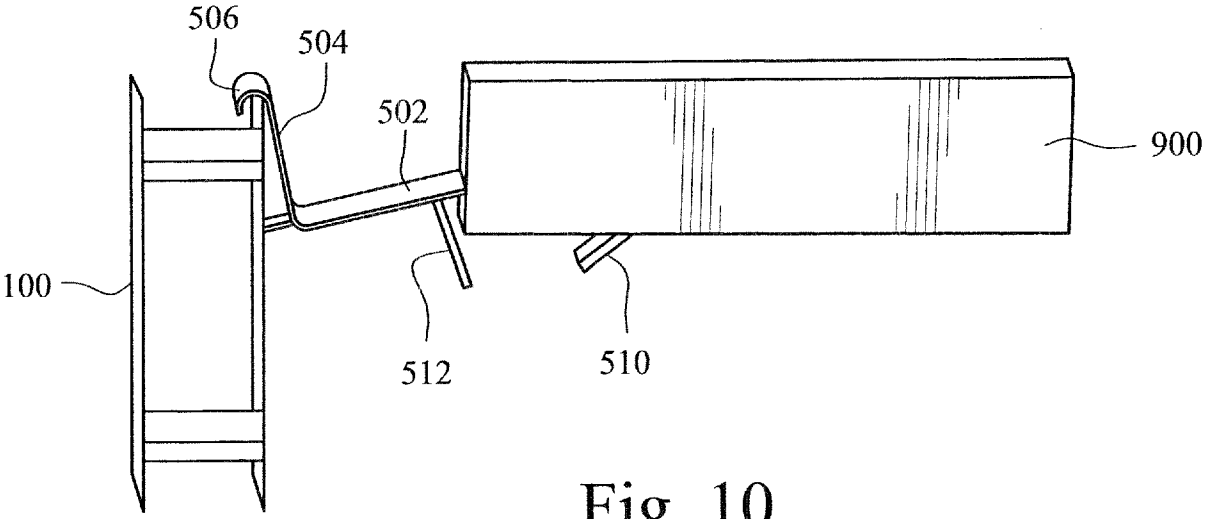
Figure 11:
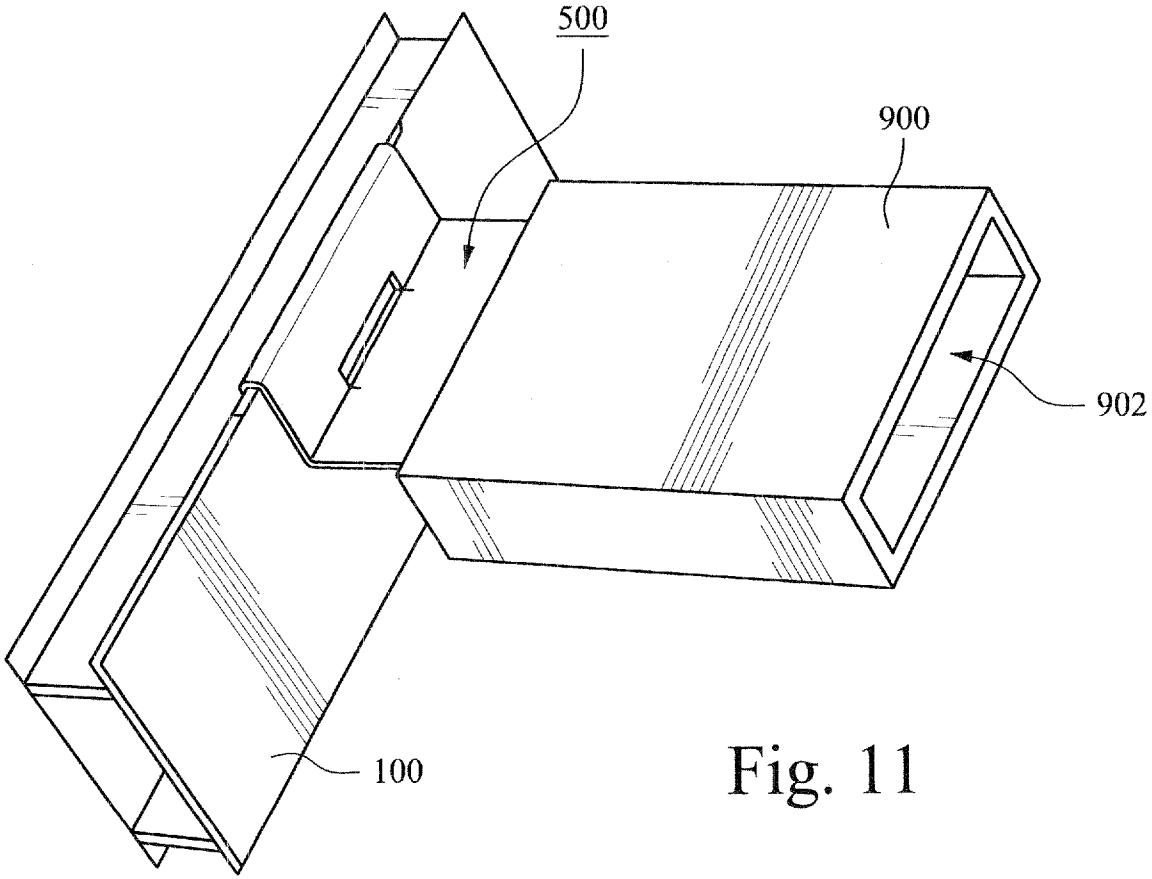

FIGS. 9-11 demonstrate an at least partially assembled keeper and grid system, including a bent clip with notched spacer design, in accordance with certain example embodiments. The keeper 500 is placed on the spacer 100. The muntin bar assembly or grid 900 includes a cavity 902 for accommodating at least a portion of the keeper 500. As shown in FIG. 9, the angled member 510 is biased upwardly as the grid 900 is slid onto the keeper 500. As the grid 900 is pushed closer towards the edge, the angled member 510 pops out through a hole in the grid 900, thereby helping to lock the elements together, e.g., as shown in FIG. 10. Also as shown in FIG. 10, the downwardly extending member 512 helps stop the grid 900 before it reaches all the way the spacer 100. FIG. 11 shows the keeper 500 being substantially concealed when the grid 900 is fully connected therewith.

As can be seen from FIG. 9, for example, the hole 514 may actually have two differently sized areas. A first area may be formed by cutting away certain portions and then bending the free material downward to form the angled member 510. A second area may be formed by cutting away certain other portions and then bending the free material downward to form the generally downwardly extending stopper member 512. The removed areas may both be substantially rectangular in shape. However, a wider and/or longer amount of material may be bent downwardly in forming the angled member 510 in certain example embodiments. As shown in FIG. 9 and elsewhere, the removed cutout portions may be substantially rectangular from plan views, although other shapes (e.g., triangular, square, etc.) may be used in different embodiments.

FIGS. 12-15 show further modifications to clip-type keepers that are possible in connection with certain example embodiments. The example keeper shown in FIG. 12 includes an upwardly extending tab 1200 rather than, or in addition to, the angled member 510. In this case, the tab 1200 may serve primarily as a guide for the grid and may engage with one or more downwardly extending features positioned on the upper surface of the interior of the grid cavity.

FIG. 13 may include a second fold 1300 for helping to cushion the grid against the spacer system. For instance, the additional fold may expand or contract as the grid is pulled away from or pushed towards the spacer system. The large punch 1310 may serve as a locating feature for the FIG. 13 example clip and may be aligned with a corresponding shaped and/or sized feature of or on the spacer.

The member 1402 shown in FIG. 14 may be similar to the extending cushioning member 508 described above. However, this member 1402 may be integral with the generally upright member 504' shown in FIG. 14. This may provide for a more solid connection in certain example instances.

The shoulder 506' shown in FIG. 15 includes one or more barbs 1502 at its end that optionally may connect with one or more corresponding feature of or on the spacer system.

FIGS. 16A-16C show different cavity spacer blade profiles that may be used in connection with certain example embodiments. As shown in FIG. 16A, for example, the blade profile may have a substantially rectangular notched out portion into which a shoulder portion of the keeper may fit. FIG. 16B shows a substantially fiat profile, and FIG. 16C shows a notched out profile that has angled or beveled edges. Of course, other profiles may be used, e.g., for accommodating the shoulder portion and/or for helping to locate the keeper.

Some or all of the following example improvements provided compared to current keeper technology may be provided by certain example embodiments:

- Designed for standard or typical muntin profiles;
- Made out of metal to reduce outgassing effects;
- Designed for use with twin blade IG spacers;
- Designed for easy alignment on a pre-notched spacer bar;
- Designed so as to not disturb on the primary sealant;
- Designed so as to not cause direct metal-to-glass contact;
- Designed to hold onto the spacer by use of small stamped sharp triangular or other-shaped projections; and/or
- Designed to hold onto the muntin bar by use of stamped projections.

The techniques disclosed herein may be used in connection with any suitable IG unit, including those with low-E coatings disposed thereon. See, for example, U.S. Pat. Nos. 7,597,963; 6,749,941; 6,132,881; 6,059,909; 6,014,872; 5,800,933; 5,770,321; 5,557,462; and 5,514,476, the disclosures of which are all hereby incorporated herein by reference. So-called triple IG units are also included. See, for example, U.S. application Ser. No. 13/324,267, filed on Dec. 13, 2011, the entire contents of which is incorporated herein by reference.

In certain example embodiments, a grid keeper for an insulating glass (IG) unit is provided. An elongate body portion is adapted to extend into a cavity of the IG unit and further adapted to be received into a cavity formed in a muntin bar or grid assembly of the IG unit. A generally upright member extends from an end of the body portion to be positioned closest to a spacer of the IG unit. A shoulder portion extends downwardly from and at an acute angle to the generally upright member. The shoulder portion is adapted to hook to an upwardly extending blade of the spacer of the IG unit.

In addition to the features of the preceding paragraph, in certain example embodiments, one or more stamped or punched out features may be located on the shoulder portion and adapted to engage with one or more corresponding features in or on the spacer.

In addition to the features of either of the two preceding paragraphs, in certain example embodiments, a cushioning member may be provided to a surface of the generally upright member that is to be positioned closest to the spacer.

In addition to the features of any one of the three preceding paragraphs, in certain example embodiments, a stopper may extend generally downwardly from the body portion, with the stopper defining an edge beyond which the muntin bar or grid assembly should not be inserted.

In addition to the features of any one of the four preceding paragraphs, in certain example embodiments, the elongate body portion may have a hole formed therein.

In addition to the features of any one of the five preceding paragraphs, in certain example embodiments, an angled member may extend generally downward from the body portion and toward the shoulder portion, with the angled member being adapted to receive a biasing force as the muntin bar or grid assembly is provided to the grid keeper.

In addition to the features of any one of the six preceding paragraphs, in certain example embodiments, a notched out area may be defined in the shoulder portion for locating the grid keeper relative to a corresponding locating feature of or on the spacer.

In addition to the features of any one of the seven preceding paragraphs, in certain example embodiments, the acute angle may be an angle less than or equal to 45 (e.g., 30) degrees.

In certain example embodiments, an insulating glass (IG) unit is provided. First and second substantially parallel spaced apart glass substrates at least partially define a gap therebetween. A spacer system is provided around edges of the first and/or second glass substrates, with the spacer system including at least one upwardly extending blade. A muntin bar assembly is located within the gap. One or more clips hold the muntin bar assembly substantially in place. Each said clip comprises: an elongate body portion extending into the gap and being received by a cavity formed in the muntin bar assembly, and a shoulder integral with the elongate body portion and configured to hook onto the blade of the spacer system at a bend thereof, with the bend being formed at an angle less than 90 degrees (e.g., 40-55 degrees, and sometimes possibly less than or equal to 30 degrees).

In addition to the features of the preceding paragraph, in certain example embodiments, each said clip may further comprise one or more stamped or punched out features located on the shoulder, with the one or more stamped or punched out features being arranged to engage with one or more corresponding features in or on the spacer system.

In addition to the features of either of the two preceding paragraphs, in certain example embodiments, each said clip may further comprises a cushioning member integral with the shoulder, with the cushioning member being provided to an inner surface of the shoulder in an area that extends generally upward and away from the body portion.

In addition to the features of any one of the three preceding paragraphs, in certain example embodiments, each said clip may further comprise a member extending generally downwardly from the body portion, with the member defining an edge beyond which the muntin bar assembly should not pass when initially inserted or due to subsequent loading.

In addition to the features of any one of the four preceding paragraphs, in certain example embodiments, the elongate body portion of each said clip may have a hole formed therein.

In addition to the features of any one of the five preceding paragraphs, in certain example embodiments, first and second portions of the elongate portion of each said clip may be cut away and bent downwardly to form first and second bent portions, with the first bent portion being located farther from the spacer system than the second bent portion.

In addition to the features of the preceding paragraph, in certain example embodiments, the first bent portion of each said clip may be adapted to receive a biasing force as the muntin bar assembly is slid into place and lock the muntin bar assembly in place once fully inserted.

In addition to the features of either of the two preceding paragraphs, in certain example embodiments, the second bent portion of each said clip may be adapted to serve as a backstop against which the muntin bar assembly can push when fully inserted.

In addition to the features of any one of the eight preceding paragraphs, in certain example embodiments, each said clip may include a notched out area in the shoulder for locating the clip relative to a corresponding locating feature of or on the spacer system.

In addition to the features of any one of the nine preceding paragraphs, in certain example embodiments, the blade of the spacer system may include one or more notched out regions for accommodating the shoulders of the one or more clips, respectively.

In addition to the features of any one of the ten preceding paragraphs, in certain example embodiments, each said clip may be spaced apart from the glass substrates.

In certain example embodiments, a method of making an insulating glass (IG) unit is provided. First and second glass substrates are provided. A spacer system is provided around edges of the first and/or second glass substrates, with the spacer system including at least one upwardly extending blade. One or more clips are connected to the blade via a bend provided to each of the clips. Elongate body portion(s) of the one or more clips is/are inserted into one or more corresponding cavities of a muntin bar assembly to hold the muntin bar assembly in place. The IG unit is sealed such that the first and second glass substrates are provided in substantially parallel spaced apart relation to one another and such that the muntin bar assembly is located in a gap between the first and second glass substrates. The bend in each said clip is provided at an acute angle less than 90 degrees (e.g., 40-55 degrees).

The method of the preceding paragraph may be modified in accordance with the features discussed above, and/or may include steps for creating the keepers/clips, in certain example embodiments.

Although certain example embodiments have been described in relation to insulating glass units with two glass substrates, the example techniques described herein may be applied to other configurations and/or arrangements. For instance, the example techniques described herein may be applied to so-called triple-IG units that include first, second, and third substantially parallel, spaced apart glass substrates, with example keepers being disposed between the first and second and/or second and third substrates in different implementations. Similarly, the example techniques described herein may be applied to vacuum insulated glass (VIG) units in certain example instances. Vacuum insulating glass (VIG) units are known in the art. For example, see U.S. Pat. Nos. 5,664,395; 5,657,607; and 5,902,652, U.S. Publication Nos. 2009/0151854; 2009/0151855; 2009/0151853; 2009/0155499; 2009/0155500, and U.S. application Ser. Nos. 12/453,220 and 12/453,221, the disclosures of which are all hereby incorporated herein by reference.

It is noted that the techniques disclosed herein may be used in connection with muntins, which sometimes are referred to as Georgian bars, grids between glass (or GBGs), shadow boxes (which may be considered a type of grid in some cases), etc., in different example embodiments. In general, the techniques described herein may be used in connection with any suitable decorative pattern (e.g., made of wood, plastic, metal, and/or the like).

The features, aspects, advantages, and example embodiments described herein may be combined to realize yet further embodiments.

"Peripheral" and "edge" seals herein do not mean that the seals are located at the absolute periphery or edge of the unit, but instead mean that the seal is at least partially located at or near (e.g., within about two inches) an edge of at least one substrate of the unit. Likewise, "edge" as used herein is not limited to the absolute edge of a glass substrate but also may include an area at or near (e.g., within about two inches) of an absolute edge of the substrate(s).

As used herein, the terms "on," "supported by," and the like should not be interpreted to mean that two elements are directly adjacent to one another unless explicitly stated. In other words, a first layer may be said to be "on" or "supported by" a second layer, even if there are one or more layers therebetween.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An insulating glass (IG) unit, comprising:

first and second substantially parallel spaced apart glass substrates at least partially defining a gap therebetween;

a spacer system provided proximate edges of the first and second glass substrates, the spacer system including at least one upwardly extending blade;

a muntin bar assembly located within the gap and defining an aperture; and at least one clip holding the muntin bar assembly substantially in place, the clip comprising:

an elongate main body portion received by a cavity formed in the muntin bar assembly;

an angled member extending from the main body and through the aperture of the muntin bar assembly in order to help lock the clip in engagement with the muntin bar assembly, wherein the angled member is configured to (i) receive a biasing force as at least one of the muntin bar assembly and the clip is slid into place and (ii) help lock the muntin bar assembly and the clip in place once fully inserted;

a shoulder portion integral with the elongate main body portion and hooked onto the blade of the spacer system;

an upright member extending between an end of the elongate main body portion and the shoulder portion; and a cushioning member extending from the upright member to contact an outer surface of the spacer system facing the gap of the IG unit at least one of (i) when the clip is installed, (ii) during expansion of the IG unit, and (iii) during contraction of the IG unit.

2. The IG unit of claim 1, wherein the clip further comprises one or more stamped or punched out features located on the shoulder portion, the one or more stamped or punched out features being arranged to engage with or lean against one or more corresponding features in or on the spacer system.

3. The IG unit of claim 2, wherein the one or more stamped or punched out features are configured to locate the clip with respect to the one or more corresponding features in or on the spacer system.

4. The IG unit of claim 2, wherein the one or more stamped or punched out features are configured to reduce a likelihood of the clip falling into the gap of the IG unit.

5. The IG unit of claim 1, wherein the elongate main body portion of each clip has a hole formed therein.

6. The IG unit of claim 5, wherein the hole in the elongate main body portion is configured to reduce the likelihood of the clip failing into the gap of the IG unit.

7. The IG unit of claim 1, wherein each clip includes a notched out area in the shoulder portion for locating the clip relative to a corresponding locating feature of or on the spacer system.

8. The IG unit of claim 1, wherein the cushioning member is configured to reduce the likelihood of the clip rotating too far inward and falling off of the blade.

9. The IG unit of claim 1, wherein an angle between the angled member and the elongate main body portion is greater than 90 degrees.

10. The IG unit of claim 9, wherein the angle is in a range between 135 and 160 degrees.

11. The IG unit of claim 1, wherein an angle between the upright member and the shoulder is less than 75 degrees.

12. The IG unit of claim 11, wherein the angle is in a range between 45 and 55 degrees.

13. The IG unit of claim 1, wherein the blade defines a notch along its edge, the notch being configured to receive the shoulder portion to hook the clip onto the spacer system.

14. The IG unit of claim 1, wherein the clip further comprises a downward extending member arranged between the angled member and the shoulder portion and extending downwardly from the elongate main body portion outside the cavity of the muntin bar assembly.

15. The IG unit of claim 14, wherein the downward extending member is configured to act as a stop for positioning the clip relative to an end of the muntin bar assembly.

* * * * *